US008137771B2

(12) United States Patent
Wu

(10) Patent No.: US 8,137,771 B2
(45) Date of Patent: Mar. 20, 2012

(54) GAS GENERATING COMPOSITION

(75) Inventor: Jianzhou Wu, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 213 days.

(21) Appl. No.: 11/206,031

(22) Filed: Aug. 18, 2005

(65) Prior Publication Data

US 2006/0062945 A1 Mar. 23, 2006

Related U.S. Application Data

(60) Provisional application No. 60/609,834, filed on Sep. 15, 2004.

(30) Foreign Application Priority Data

Sep. 9, 2004 (JP) ..... 2004-262027

(51) Int. Cl.
*B32B 1/02* (2006.01)
*C06B 45/10* (2006.01)
*B32B 1/08* (2006.01)

(52) U.S. Cl. ..... 428/34.1; 428/34.2; 428/35.2; 428/35.7; 428/35.9; 428/36.9; 149/19.1; 149/19.2

(58) Field of Classification Search ..... 428/34.1, 428/34.2, 35.7, 36.9, 35.2, 35.9; 149/19.1, 149/19.2
See application file for complete search history.

(56) References Cited

U.S. PATENT DOCUMENTS

| | | | | |
|---|---|---|---|---|
| 3,647,393 | A * | 3/1972 | Leising et al. | 280/736 |
| 4,369,079 | A | 1/1983 | Shaw | |
| 4,370,181 | A | 1/1983 | Lundstrom et al. | |
| 4,909,549 | A | 3/1990 | Poole et al. | |
| 5,104,466 | A | 4/1992 | Allard et al. | |
| 5,178,696 | A * | 1/1993 | Ikeda et al. | 149/18 |
| 5,460,668 | A | 10/1995 | Lyon | |
| 5,542,997 | A * | 8/1996 | Zeuner et al. | 149/35 |
| 5,542,999 | A | 8/1996 | Bucerius et al. | |
| 5,608,183 | A | 3/1997 | Barnes et al. | |
| 6,033,500 | A | 3/2000 | Ito et al. | |
| 6,143,102 | A | 11/2000 | Mendenhall et al. | |
| 6,332,404 | B1 * | 12/2001 | Rink et al. | 102/530 |
| 6,517,647 | B1 * | 2/2003 | Yamato | 149/45 |
| 6,652,608 | B1 * | 11/2003 | Orr | 44/360 |
| 6,811,626 | B2 | 11/2004 | Serizawa et al. | |
| 2003/0024618 | A1 | 2/2003 | Wu et al. | |
| 2004/0154712 | A1 | 8/2004 | Yokoyama et al. | |

FOREIGN PATENT DOCUMENTS

| | | | |
|---|---|---|---|
| CN | 1235945 | A | 11/1999 |
| CN | 1280974 | A | 1/2001 |
| CN | 1446781 | A | 10/2003 |
| EP | 0736506 | A1 | 10/1996 |
| EP | 1241153 | A1 | 9/2002 |
| JP | 5-70109 | A | 3/1993 |
| JP | 6-239684 | A | 8/1994 |
| JP | 9-501392 | A | 2/1997 |
| JP | 10-502610 | A | 3/1998 |
| JP | 2001-97176 | A | 4/2001 |
| JP | 2001-220282 | A | 8/2001 |
| JP | 2002-97095 | A | 4/2002 |
| JP | 2005-145718 | A | 6/2005 |
| WO | WO 92/19571 | A1 | 11/1992 |
| WO | WO 95/18779 | A1 | 7/1995 |
| WO | WO 97/05087 | A1 | 2/1997 |

OTHER PUBLICATIONS

French Preliminary Search Report dated Jul. 16, 2009.
English translation of Chinese Office Action issued on Mar. 2008 in corresponding Chinese Application No. 200510099805.7.
Japanese Office Action issued on Apr. 13, 2010 in corresponding Japanese Application No. 2004-262027.
Office Action mailed Aug. 3, 2010 for Japanese application No. 2004-262027.

* cited by examiner

*Primary Examiner* — Marc Patterson
(74) *Attorney, Agent, or Firm* — Birch, Stewart, Kolasch & Birch, LLP

(57) ABSTRACT

A gas generating composition that can suppress the generation of mist is provided. The above gas generating composition comprises (a) a fuel, (b) an oxidizer, and (c) a compound selected from a group comprising a phosphoric acid compound or a salt thereof. The content ratio of (c) in the above composition is preferably 0.1 to 5 mass %.

12 Claims, No Drawings

GAS GENERATING COMPOSITION

CROSS-REFERENCE TO RELATED APPLICATIONS

This Nonprovisional application claims priority under 35 U.S.C. §119(e) on U.S. Provisional Application No. 60/609,834 filed on Sep. 15, 2004, the entire contents of which are hereby incorporated by reference.

TECHNICAL FIELD

The present invention relates to a gas generating composition suitable for an airbag restraint system for automobiles, etc., and a molded article thereof.

PRIOR ART

Compositions containing sodium azide have been widely used as the gas generating composition for air bag systems used as vehicle occupant safety devices in the past. However, the toxicity of sodium azide in humans [$LD_{50}$ (oral-rat)=27 mg/kg)] and danger during handling have been considered problematic, and safer gas generating compositions that contain various nitrogenous organic compounds, in other words, "non-azide gas generating compositions," have been developed as an alternative.

U.S. Pat. No. 4,909,549 discloses a composition comprising a tetrazole or triazole compound containing hydrogen and an oxygen containing oxidizer compound. U.S. Pat. No. 4,370,181 discloses a gas generating composition comprising a metal salt of a non-hydrogen containing tetrazole compound and a non-oxygen containing oxidizer. U.S. Pat. No. 4,369,079 discloses a gas generating composition comprising a metal salt of a non-hydrogen containing bitetrazole compound and an alkali metal nitrate, alkali metal nitrite, alkaline earth metal nitrate, alkaline earth metal nitrite, or a mixture thereof. U.S. Pat. No. 5,542,999 discloses a gas generating composition comprising a fuel such as GZT, TAGN (triaminoguanidine nitrate), NG (nitroguanidine), NTO, etc., a basic copper nitrate, a catalyst to reduce toxic gases, and a coolant. U.S. Pat. No. 5,608,183 discloses a gas generating composition comprising a fuel such as guanidine nitrate, a basic copper nitrate, and guar gum.

However, a residue (mist) is generated after combustion with the above non-azide gas generating compositions, and a filter is needed to prevent a residue from flowing into the airbag. In such a case, can be employed a method of preparing a composition that readily forms a slag to be easily trapped by the filter after the gas generating composition is burnt.

U.S. Pat. No. 6,143,102 discloses the addition of silica as a slag-forming agent to a composition comprising a fuel such as guanidine nitrate, a basic copper nitrate, and a metal oxide such as alumina, such that an excellent slag (clinker) will be formed. JP-A No. 10-502610 discloses that the combustion temperature is lowered by the addition of glass powder to a fuel such as a tetrazole compound and strontium nitrate, and as a result the content of NOx and CO is decreased, and a solid slag is formed thereby. U.S. Pat. No. 5,104,466 (JP-A No. 5-70109) discloses the decrease in the amount of mist by using a mixture of an alkali metal azide, pellets comprising an oxidizer, and particles comprising a silica-containing substance.

Although it is possible to lower the combustion temperature and decrease the content of NOx, etc., by the addition of glass powder as described in JP-A No. 10-502610, there is still room for improvement because glass powder is expensive, weight of the gas generator is increased by such a method, etc.

DISCLOSURE OF THE INVENTION

The present invention solves the problems resulting from the method involving the addition of glass powder by providing a novel gas generating composition that can easily form a slag and reduce the content of NOx, CO, etc.

As a means of solving the problems in the above-mentioned prior art problem, the inventor of the present invention have already filed an application for an invention of a combination of glass powder, aluminum oxide, etc., (JP-A No. 2005-145718 equivalent to JP application No. 2003-364024).

While conducting research for the above invention, the inventors paid careful attention to the state of the combustion residue after the gas generating composition is burnt and the post-combustion levels of NOx and CO, etc. And after additional research, they discovered that a post-combustion residue state and a decrease in the amounts of NOx and CO that are equivalent to cases wherein glass powder is used can be attained by using a phosphate, thereby completing the present invention.

In other words, as a means of solving the problem, the present invention provides a gas generating composition comprising (a) a fuel, (b) an oxidizer, and (c) a compound selected from the group consisting of a phosphoric acid compound or a salt thereof.

The gas generating composition and molded article thereof of the present invention comprise a compound selected from the group consisting of a phosphoric acid compound or a salt thereof; thus, the combustion residue does not become mist discharged outside of the inflator because the combustion residue is solidified and forms a slag. Moreover, when the gas generating composition comprises a phosphate, etc., the levels of post-combustion NOx and CO can be reduced.

DESCRIPTION OF THE PREFERRED EMBODIMENTS

Component (a)

The fuel of Component (a) used in the present invention, comprises at least one selected among tetrazole compounds, guanidine compounds, triazine compounds, and nitroamine compounds. By using any of the items listed for Component (a), an object of the present invention is achieved and the effect of the invention can be obtained.

A preferred example of tetrazole compounds includes 5-aminotetrazole, bitetrazole ammonium salts, etc. A preferred example of guanidine compounds includes nitrate salt of guanidine (guanidine nitrate), aminoguanidine nitrate, nitroguanidine, triaminoguanidine nitrate, etc. A preferred example of triazine compounds includes melamine, cyanuric acid, ammeline, ammelide, ammelande, etc. A preferred example of nitroamine compounds includes cyclo-1,3,5-trimethylene-2,4,6-trinitramine, etc.

Component (b)

The oxidizer of Component (b) used in the present invention, comprises at least one selected among Component (b-1) a basic metal nitrate, a nitrate or ammonium nitrate and Component (b-2) a perchlorate or a chlorate. By using any of the items listed for Component (b), an object of the present invention is achieved and the effect of the invention can be obtained.

An example of the basic metal nitrate salt of Component (b-1) includes at least one selected among basic copper nitrate, basic cobalt nitrate, basic zinc nitrate, basic manganese nitrate, basic iron nitrate, basic molybdenum nitrate, basic bismuth nitrate, and basic selenium nitrate.

To increase the burning rate, the average particle size of the basic metal nitrate, is preferably not more than 30 μm and more preferably not more than 10 μm. In this case, the average particle size is measured by a particle size distribution method utilizing laser diffraction. A basic metal nitrate salt that has been dispersed in water, and then exposed to ultrasonic waves for 3 minutes is used as the measurement sample; the 50% particle count cumulative value ($D_{50}$) is determined, and the mean particle size is considered to be the average of two measurements.

The nitrate of Component (b-1) includes alkali metal nitrates such as potassium nitrate, sodium nitrate, etc., and alkaline earth metal nitrates such as strontium nitrate, etc.

The perchlorate or chlorate of Component (b-2) is a component that not only has an oxidizing action but also a combustion promoting action. The term "oxidizing action" refers to an action that enables efficient combustion by generating oxygen during combustion and also reduces the amount of toxic gases such as ammonia and CO that are produced. On the other hand, the term "combustion promoting action" refers to an action whereby ignition of the gas generating composition is increased and the burning rate is increased.

The perchlorate or chlorate includes at least one selected among ammonium perchlorate, potassium perchlorate, sodium perchlorate, potassium chlorate, and sodium chlorate.

Component (c)

The Component (c) used in the present invention is an component that traps the mist generated by combustion and forms a slag. Because the gas generating composition contains Component (c), the combustion residue can be prevented from becoming mist, being discharged outside of the inflator, and flowing into the airbag.

Examples of Component (c) include one or a combination of at least two selected among a phosphoric acid compound or a salt thereof such as phosphoric acid, phosphorus acid, hypophosphorus acid, pyrophosphoric acid, metaphosphoric acid, polyphosphoric acid, ultraphosphoric acid, etc. Moreover, the salts listed below may take the form of either crystals or an anhydride. By using any of the items listed for Component (c), an object of the present invention is achieved and the effect of the invention can be obtained.

Phosphate Salts

Potassium dihydrogen phosphate, potassium hydrogen phosphate, and tribasic potassium phosphate; sodium dihydrogen phosphate, sodium hydrogen phosphate, and tribasic sodium phosphate; calcium dihydrogen phosphate, calcium hydrogen phosphate, and tribasic calcium phosphate; magnesium dihydrogen phosphate, magnesium hydrogen phosphate, and tribasic magnesium phosphate; ammonium dihydrogen phosphate, and ammonium hydrogen phosphate, etc.

Phosphite Salts

Sodium phosphite, sodium hypophosphite, etc.

Pyrophosphate Salts

Sodium pyrophosphate and sodium dihydrogen pyrophosphate; calcium pyrophosphate and calcium dihydrogen pyrophosphate; potassium pyrophosphate, calcium pyrophosphate, and magnesium pyrophosphate, etc.

Metaphosphate Salts

Sodium metaphosphate, potassium metaphosphate, magnesium metaphosphate, and aluminum metaphosphate, etc.

Polyphosphate Salts

Sodium tripolyphosphate, sodium tetrapolyphosphate, sodium pentapolyphosphate, potassium tripolyphosphate, calcium dihydrogen pyrophosphate, dicalcium pyrophosphate, etc.

Ultraphosphate Salts

Sodium ultraphosphate, etc.

Among the above, a preferred example of Component (c) includes potassium dihydrogen phosphate, potassium tripolyphosphate, potassium metaphosphate, calcium dihydrogen pyrophosphate, calcium pyrophosphate, sodium tripolyphosphate, magnesium metaphosphate, aluminum metaphosphate and tribasic aluminum phosphate.

Component (d)

The present invention can also contain Component (d), aluminum hydroxide and/or magnesium hydroxide. The aluminum hydroxide and magnesium hydroxide can be used alone or in combination. By using any of the items listed for Component (d), an object of the present invention is achieved and the effect of the invention can be obtained.

The aluminum hydroxide and magnesium hydroxide of Component (d) have low toxicity, have a high temperature of initial decomposition, and when they undergo thermal decomposition, they absorb a large amount of heat and generate aluminum oxide or magnesium oxide and water. By including aluminum hydroxide and/or magnesium hydroxide in the gas generating composition, the combustion temperature is lowered, and lower amounts of post-combustion toxic NOx and CO are formed.

Component (e)

The present invention can also contain Component (e), a binder. By using any of the items listed for Component (d), an object of the present invention is achieved and the effect of the invention can be obtained.

The binder of Component (e) can be one or two or more selected among carboxymethyl cellulose (CMC), carboxymethyl cellulose sodium (CMCNa), carboxymethyl cellulose potassium, carboxymethyl cellulose ammonium, cellulose acetate, cellulose acetate butyrate (CAB), methylcellulose (MC), ethylcellulose (EC), hydroxyethyl cellulose (HEC), ethylhydroxy ethylcellulose (EHEC), hydroxypropyl cellulose (HPC), carboxymethyl ethylcellulose (CMEC), microcrystalline cellulose, polyacrylamide, polyacrylamide amino compounds, polyacryl hydrazide, acrylamide-acrylic acid metal salt copolymer, polyacrylamide-polyacrylic acid ester compound copolymer, polyvinyl alcohol, acrylic rubber, guar gum, starch, and silicone.

Among the above, carboxymethyl cellulose sodium (CMCNa) and guar gum are preferred in consideration of the cohesive properties, cost, ignition, etc., of the binder.

Component (f)

The present invention can also contain Component (f), an additive. By using any of the items listed for Component (f), an object of the present invention is achieved and the effect of the invention can be obtained.

The additive of Component (f) can be one or two or more selected among metal oxides such as copper oxide, iron oxide, zinc oxide, cobalt oxide, manganese oxide, molybdenum oxide, nickel oxide, bismuth oxide, gallium oxide, silica, alumina, etc.; metal carbonates or basic metal carbonates such as cobalt carbonate, calcium carbonate, magnesium carbonate, basic zinc carbonate, basic copper carbonate, etc.; complexes of metal oxides or hydroxides such as acid clay, kaolin, talc, bentonite, diatomaceous earth, hydrotalcite, etc.; salts of oxometallic acids such as sodium silicate, mica molybdate, cobalt molybdate, ammonium molybdate, etc.; molybdenum disulfide, calcium stearate, silicon nitride, and silicon carbide. These additives can lower the combustion temperature of the gas generating composition, regulate the burning rate, and reduce the amounts of post-combustion toxic NOx and CO that are produced. Among these additives, copper oxide, iron oxide, and magnesium oxide are preferred.

Content Ratio of Components in the Composition (1) First Combination

When the composition of the present invention contains three components, (a), (b), and (c), the following content ratio of the respective components is preferred from the standpoint of achieving an object of the present invention.

The content ratio of the fuel of Component (a) is preferably 35 to 65 mass %, more preferably 40 to 60 mass %, and still more preferably 40 to 55 mass %.

The content ratio of the oxidizer of Component (b) is preferably 30 to 70 mass %, more preferably 35 to 65 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

(2) Second Combination

When the composition of the present invention contains four components, (a), (b), (c), and (d), the following content ratio of the respective components is preferred from the standpoint of achieving an object of the present invention.

The content ratio of the fuel of Component (a) is preferably 30 to 60 mass %, more preferably 35 to 55 mass %, and still more preferably 35 to 50 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of aluminum hydroxide and/or magnesium hydroxide of Component (d) is preferably 0.5 to 15 mass %, more preferably 2 to 12 mass %, and still more preferably 3 to 10 mass %.

When the content of Component (d) lies within the above range, not only can the amount of toxic NOx and CO be lowered in association with the decrease in combustion temperature, but also when the composition of the present invention is utilized in an airbag inflator, a burning rate necessary for the expansion and deployment of the airbag within the desired time can be assured.

From the standpoint of increasing mist trapping effectiveness, the combined content ratio of Component (c) and Component (d) in the present invention is preferably 0.5 to 20 mass %, more preferably 2 to 15 mass %, and still more preferably 3 to 10 mass %.

Similarly, from the standpoint of increasing mist trapping effectiveness, the mass ratio of Component (c) and Component (d) in the present invention [(d)/(c)], is preferably 1 to 20, more preferably 2 to 15, and still more preferably 3 to 10.

(3) Third Combination

When the composition of the present invention contains four components, (a), (b), (c), and (e), the following content ratio of the respective components is preferred from the standpoint of achieving an object of the present invention.

The content ratio of the fuel of Component (a) is preferably 25 to 55 mass %, more preferably 30 to 55 mass %, and still more preferably 35 to 45 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of the binder of Component (e) is preferably 0.5 to 20 mass %, more preferably 2 to 15 mass %, and still more preferably 3 to 10 mass %.

(4) Fourth Combination

When the composition of the present invention contains four components, (a), (b), (c), and (f), the following content ratio of the respective components is preferred from the standpoint of achieving an object of the present invention.

The content ratio of the fuel of Component (a) is preferably 25 to 55 mass %, more preferably 30 to 55 mass %, and still more preferably 35 to 45 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of the additive of Component (f) is preferably 0.1 to 15 mass %, more preferably 0.5 to 10 mass %, and still more preferably 1 to 5 mass %.

(5) Fifth Combination

When the composition of the present invention contains five components, (a), (b), (c), (d), and (e), the following content ratio of the respective components is preferred from the standpoint of achieving an object of the present invention.

The content ratio of the fuel of Component (a) is preferably 25 to 55 mass %, more preferably 30 to 55 mass %, and still more preferably 35 to 45 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of aluminum hydroxide and/or magnesium hydroxide of Component (d) is preferably 0.5 to 15 mass %, more preferably 2 to 12 mass %, and still more preferably 3 to 10 mass %.

The content ratio of the binder of Component (e) is preferably 0.5 to 20 mass %, more preferably 2 to 15 mass %, and still more preferably 3 to 10 mass %. The above content ratio is preferred when Component (e) is used in combination with Component (d) because the combustion gases can be purified with no loss of moldability.

(6) Sixth Combination

When the composition of the present invention contains five components, (a), (b), (c), (d), and (f), the following content ratio of the respective components is preferred from the standpoint of achieving an object of the present invention.

The content ratio of the fuel of Component (a) is preferably 25 to 55 mass %, more preferably 30 to 55 mass %, and still more preferably 35 to 45 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of aluminum hydroxide and/or magnesium hydroxide of Component (d) is preferably 0.5 to 15 mass %, more preferably 2 to 12 mass %, and still more preferably 3 to 10 mass %.

The content ratio of the additive of Component (f) is preferably 0.1 to 15 mass %, more preferably 0.5 to 10 mass %, and still more preferably 1 to 5 mass %.

(7) Seventh Combination

When the composition of the present invention contains six components, (a), (b), (c), (d), (e), and (f), the following content ratio of the respective components is preferred from the standpoint of achieving an object of the present invention.

The content ratio of the fuel of Component (a) is preferably 25 to 55 mass %, more preferably 30 to 55 mass %, and still more preferably 35 to 45 mass %.

The content ratio of the oxidizer of Component (b) is preferably 35 to 70 mass %, more preferably 40 to 60 mass %, and still more preferably 45 to 55 mass %.

The content ratio of the phosphoric acid compound or a salt thereof of Component (c) is preferably 0.1 to 5 mass %, more preferably 0.2 to 3 mass %, and still more preferably 0.5 to 1.5 mass %.

The content ratio of aluminum hydroxide and/or magnesium hydroxide of Component (d) is preferably 0.5 to 15 mass %, more preferably 2 to 12 mass %, and still more preferably 3 to 10 mass %.

The content ratio of the binder of Component (e) is preferably 0.5 to 20 mass %, more preferably 2 to 15 mass %, and still more preferably 3 to 10 mass %. The above content ratio is preferred when Component (e) is used in combination with Component (d) because the combustion gases can be purified with no loss of moldability.

The content ratio of the additive of Component (f) is preferably 0.1 to 15 mass %, more preferably 0.5 to 10 mass %, and still more preferably 1 to 5 mass %.

Composition Examples

| (1) Composition Example 1 | |
|---|---|
| (a) Guanidine nitrate | 53.1 mass % |
| (b) Basic copper nitrate | 46.4 mass % |
| (c) Tribasic aluminum phosphate | 0.5 mass % |
| (2) Composition Example 2 | |
| (a) Guanidine nitrate | 51.5 mass % |
| (b) Basic copper nitrate | 45.0 mass % |
| (c) Sodium tetrapolyphosphate | 0.5 mass % |
| (d) Aluminum hydroxide | 3.0 mass % |
| (3) Combination Example 3 | |
| (a) Guanidine nitrate | 44.4 mass % |
| (b) Basic copper nitrate | 45.6 mass % |
| (c) Tribasic aluminum phosphate | 1.0 mass % |
| (d) Aluminum hydroxide | 5.0 mass % |
| (e) CMCNa | 4.0 mass % |

The gas generating composition of the present invention can be molded into a desired shape and can be prepared as a molded article in the form of a single-perforated cylinder, a porous cylinder, and pellets. These molded articles can be manufactured by a method wherein water or an organic solvent is added to and mixed with the gas generating composition and extrusion molding is performed (in case of molded article in the form of a single-perforated cylinder or a porous cylinder), or by a method wherein compression molding is performed using a pelletizer, etc. (in the case of molded article in pellet form).

The gas generating composition of the present invention and the molded article obtained therefrom can be used, for example, in an airbag inflator for the driver side, an airbag inflator for a passenger side next to the driver, side airbag inflator, inflatable curtain inflator, knee bolster inflator, inflatable seatbelt inflator, tubular system inflator, and a gas generator for pretensioner in various types of vehicles.

Moreover, inflators using the gas generating composition of the present invention and the molded article obtained therefrom may be used in either a pyrotechnic type inflator, in which only a gas generating agent supplies a gas, or a hybrid type, in which both a compressed gas such as argon, etc., and a gas generating agent supply a gas.

Furthermore, the gas generating composition of the present invention and the molded article obtained therefrom can be used as an igniting agent referred to as an enhancer (or booster), etc., for transferring the energy of a detonator or squib to the gas generating composition.

EXAMPLES

Example 1

A mixture of 2081 g of guanidine nitrate, 2319 g of basic copper nitrate, 150 g of CMCNa, 400 g of aluminum hydroxide, 50 g of sodium polyphosphate, and 735 g of water was kneaded together in a 10 L kneader, molded by extrusion, and passed through cutting, drying and sieving process steps, etc., to obtain a molded article of a gas generating composition in the form of a single perforated strand having an outer diameter of 4.3 mm, an inner diameter of 1.1 mm and a length of 4.1 mm.

An amount of 39.9 g of the molded article of the gas generating composition was placed in a single inflator for a driver side and subjected to a 60 L gas cylinder test (a widely known test method disclosed in Paragraph No. 98 of JP-A No. 2001-97176). As a result, the amount of mist in the cylinder was 692 mg at a maximum tank pressure 181 kPa.

In addition, this inflator was actuated in a 2800 L gas cylinder, and the concentrations of NOx, CO, and $NH_3$ in the exhaust gases inside the gas cylinder were measured. In the 2800 L gas cylinder test, the test inflator was placed in an iron gas cylinder with a capacity of 2800 L, and the concentrations of NO, $NO_2$, CO, and $NH_3$ in the gas cylinder were measured at 3 minutes, 15 minutes and 30 minutes after the inflator was ignited; the mean value of the gas concentration at 3 minutes, 15 minutes and 30 minutes was used as the concentration for each gas.

The following results were obtained: $NO_2$: 0 ppm, NO: 11 ppm, CO: 40 ppm, and $NH_3$: 4 ppm. These results demonstrate that there was only a small amount of mist and the exhaust gases are clean.

The invention claimed is:

1. A gas generating composition for an airbag consisting essentially of:

(a) 35 to 65 mass % of a fuel of guanidine nitrate;

(b) 30 to 70 mass % of an oxidizer of basic copper nitrate; and (c) 0.1 to 5 mass % at least one salt of a phosphoric acid compound selected from the group consisting of:

a phosphate salt selected from the group consisting of potassium dihydrogen phosphate, potassium hydrogen phosphate, tribasic potassium phosphate, sodium dihydrogen phosphate, sodium hydrogen phosphate, tribasic sodium phosphate, sodium tetrapolyphosphate, magnesium dihydrogen phosphate, magnesium hydrogen phosphate, tribasic magnesium phosphate, and tribasic aluminum phosphate, and optionally, (d) aluminum hydroxide and/or magnesium hydroxide, (e) a binder, and/or, (f) an additive.

2. The gas generating composition according to claim 1, wherein the gas generating composition contains (d) aluminum hydroxide and/or magnesium hydroxide.

3. The gas generating composition according to claim 1, wherein the gas generating composition contains (e) a binder, and/or (f) an additive.

4. A molded article of the gas generating composition, in the form of a single-perforated cylinder or a porous cylinder, obtained by extruding and molding the gas generating composition according to claim 1.

5. The gas generating composition according to claim 1, wherein the content of (c) in the composition is 0.2 to 3 mass %.

6. The gas generating composition according to claim 1, wherein the salt of the phosphoric acid compound is tribasic aluminum phosphate.

7. The gas generating composition according to claim 1, wherein (c) the salt of the phosphoric acid compound is tribasic aluminum phosphate and/or sodium tetrapolyphosphate.

8. The gas generating composition according to claim 7, wherein the gas generating composition contains (d) aluminum hydroxide, and (e) the binder is carboxymethyl cellulose sodium (CMCNa), wherein the content of (d) in the composition is 0.5 to 15 mass %, and the content of (e) in the composition is 0.5 to 20 mass %.

9. The gas generating composition according to claim 1, which consists of said components.

10. The gas generating composition according to claim 8, which consists of said components.

11. The gas generating composition according to claim 7, wherein the gas generating composition contains the binder and is in the form of a pellet.

12. The gas generating composition according to claim 11, wherein the gas generating composition contains (d) aluminum hydroxide, and the component (c) is sodium polyphosphate.

* * * * *